US011739926B1

(12) United States Patent
Li

(10) Patent No.: US 11,739,926 B1
(45) Date of Patent: Aug. 29, 2023

(54) LAMP

(71) Applicant: Shenzhen Ansen Illumination Technology Co., Ltd., Shenzhen (CN)

(72) Inventor: Tingshuai Li, Lianjiang (CN)

(73) Assignee: Shenzhen Ansen Illumination Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/975,039

(22) Filed: Oct. 27, 2022

(51) Int. Cl.
*F21V 23/06* (2006.01)
*F21V 15/01* (2006.01)
*F21Y 113/10* (2016.01)

(52) U.S. Cl.
CPC ..... *F21V 23/06* (2013.01); *F21V 15/01* (2013.01); *F21Y 2113/10* (2016.08)

(58) Field of Classification Search
CPC ..... F21V 23/007–009; F21V 29/502; F21V 29/506; F21V 29/507; F21V 29/70; F21K 9/20–239
See application file for complete search history.

(56) References Cited

FOREIGN PATENT DOCUMENTS

CN 101680613 A * 3/2010 ..... F21K 9/135
CN 104011458 A * 8/2014 ..... F21K 9/23
CN 106062463 A * 10/2016 ..... F21K 9/232
CN 107850277 A * 3/2018 ..... F21S 8/02

* cited by examiner

*Primary Examiner* — Anabel Ton
(74) *Attorney, Agent, or Firm* — Jeenam Park

(57) ABSTRACT

The invention provides a lamp that includes a power connection part and an illumination part. The power connection part includes a transparent casing, a wire component and a power supply component, where a mounting channel is formed in the transparent casing and includes a first end part and a second end part communicating with the first end part; the first end part and the second end part both penetrate through the transparent casing; and the wire component is inserted in the mounting channel, an accommodating space is arranged in the wire component, the power supply component is arranged in the accommodating space, and a port penetrating through the second end part of the transparent casing is located in the accommodating space. The illumination part comprises a heat dissipation base and a light-emitting component, where the wire component is fixed on the heat dissipation base, the heat dissipation base is mounted on the transparent casing, and a mounting space is formed between the heat dissipation base and the transparent casing; the light-emitting component is embedded on the heat dissipation base, located in the mounting space and outside the wire component, and is electrically connected with the power supply component; and light emitted by the light-emitting component is emitted to the outside of the lamp through the transparent casing, so that a lamp post of the lamp cannot be seen.

9 Claims, 2 Drawing Sheets

LAMP

TECHNICAL FIELD

The invention belongs to the technical field of illumination, and in particular, relates to a lamp.

BACKGROUND

Existing lamps not only play a role in illumination, but also play a role in decoration. After a lamp is mounted in a preset position, a lamp post of the lamp is easy to see when the lamp is not used for illumination, thereby affecting the decorative effect of the lamp.

SUMMARY

A technical problem to be solved by the present invention is to provide a lamp for the problem in the prior art that a lamp post of the lamp is easy to see when the lamp is not used for illumination, thereby affecting the decorative effect of the lamp.

In order to solve the technical problem, an embodiment of the invention provides a lamp. The lamp includes a power connection part and an illumination part, wherein the power connection part comprises a transparent casing, a wire component and a power supply component, a mounting channel is arranged in the transparent casing, the mounting channel comprises a first end part and a second end part communicating with the first end part, the first end part and the second end part both penetrate through the transparent casing, the wire component is inserted in the mounting channel, an accommodating space is arranged in the wire component, the power supply component is arranged in the accommodating space, and a port penetrating through the second end part of the transparent casing is located in the accommodating space; the illumination part includes a heat dissipation base and a light-emitting component; the wire component is fixed on the heat dissipation base, the heat dissipation base is mounted on the transparent casing, and a mounting space is formed between the heat dissipation base and the transparent casing; and the light-emitting component is embedded on the heat dissipation base, located in the mounting space and outside the wire component, and is electrically connected with the power supply component, and light emitted by the light-emitting component is emitted to the outside of the lamp through the transparent casing.

Optionally, the power supply component includes a color-tuning power supply, the light-emitting component includes a plurality of light boards, and light-emitting colors of all the light boards are different, and the light boards are electrically connected to the color-tuning power supply.

Optionally, the power connection part further includes a power connection component, the power connection component is arranged on the transparent casing, the power supply component is electrically connected with the power connection component, the power connection component is used for being connected with a lamp holder, and the power connection component covers the port penetrating through the first end part of the transparent casing.

Optionally, the lamp further includes a spotlight part, where the spotlight part keeps off the power connection part and the illumination part; the power supply component includes a spotlight power supply; the spotlight part includes a mounting base, a spotlight light source and a lens assembly; and the mounting base is fixed on the heat dissipation base, the spotlight light source and the lens assembly are embedded on the mounting base, the spotlight light source is electrically connected with the spotlight power supply, light emitted by the spotlight light source passes through the lens assembly, and the emitted light passing through the lens assembly is emitted to the outside of the lamp.

Optionally, a light-emitting end of the spotlight light source faces away from the transparent casing.

Optionally, the mounting base and the heat dissipation base are integrally arranged.

Optionally, a mounting groove is formed in the mounting base, the spotlight part further includes a first clamping ring, the first clamping ring is clamped on an inner wall of the mounting groove along a depth direction, and is arranged along a circumferential direction of the inner wall of the mounting groove along the depth direction, the first clamping ring is annularly arranged on the lens assembly, and the emitted light passing through the lens assembly penetrates through an inner ring of the first clamping ring to be emitted to the outside of the lamp.

Optionally, the spotlight part further includes a fixed cylinder and a movable cylinder, the fixed cylinder is fixed on the mounting base, a central shaft of the movable cylinder and a central shaft of the fixed cylinder are collinearly arranged, the spotlight light source is arranged in the fixed cylinder, the lens assembly is arranged in the movable cylinder, and the movable cylinder has a locked state and an unlocked state; and when the movable cylinder is in the locked state, the movable cylinder is limited on the fixed cylinder, and when the movable cylinder is in the unlocked state, the movable cylinder drives the lens assembly to move away from or close to the mounting base on the fixed cylinder.

Optionally, the spotlight part further includes a second clamping ring, the second clamping ring is clamped on an inner wall of the movable cylinder, and is arranged along a circumferential direction of the inner wall of the movable part, the second clamping ring is annularly arranged on the lens assembly, and the emitted light passing through the lens assembly penetrates through an inner ring of the second clamping ring to be emitted to the outside of the lamp.

Optionally, the transparent casing is a vaporous polycarbonate (hereafter referred to as "PC") or a transparent PC.

According to the lamp provided by the embodiment of the invention, after the lamp is mounted at a preset position and when the lamp is not used for illumination or is used for illumination, the wire component can be been through the transparent casing and the lamp post of a conventional lamp cannot be seen, so that the lamp has a good decorative effect. The wire component plays a role in hiding the power supply component. The heat dissipation base plays a role in heat dissipation, so that heat in the mounting space can be rapidly transferred to the outside of the lamp. The light-emitting component is embedded on the heat dissipation base, and it is difficult to see the light-emitting component directly through the transparent casing.

Figure 1:
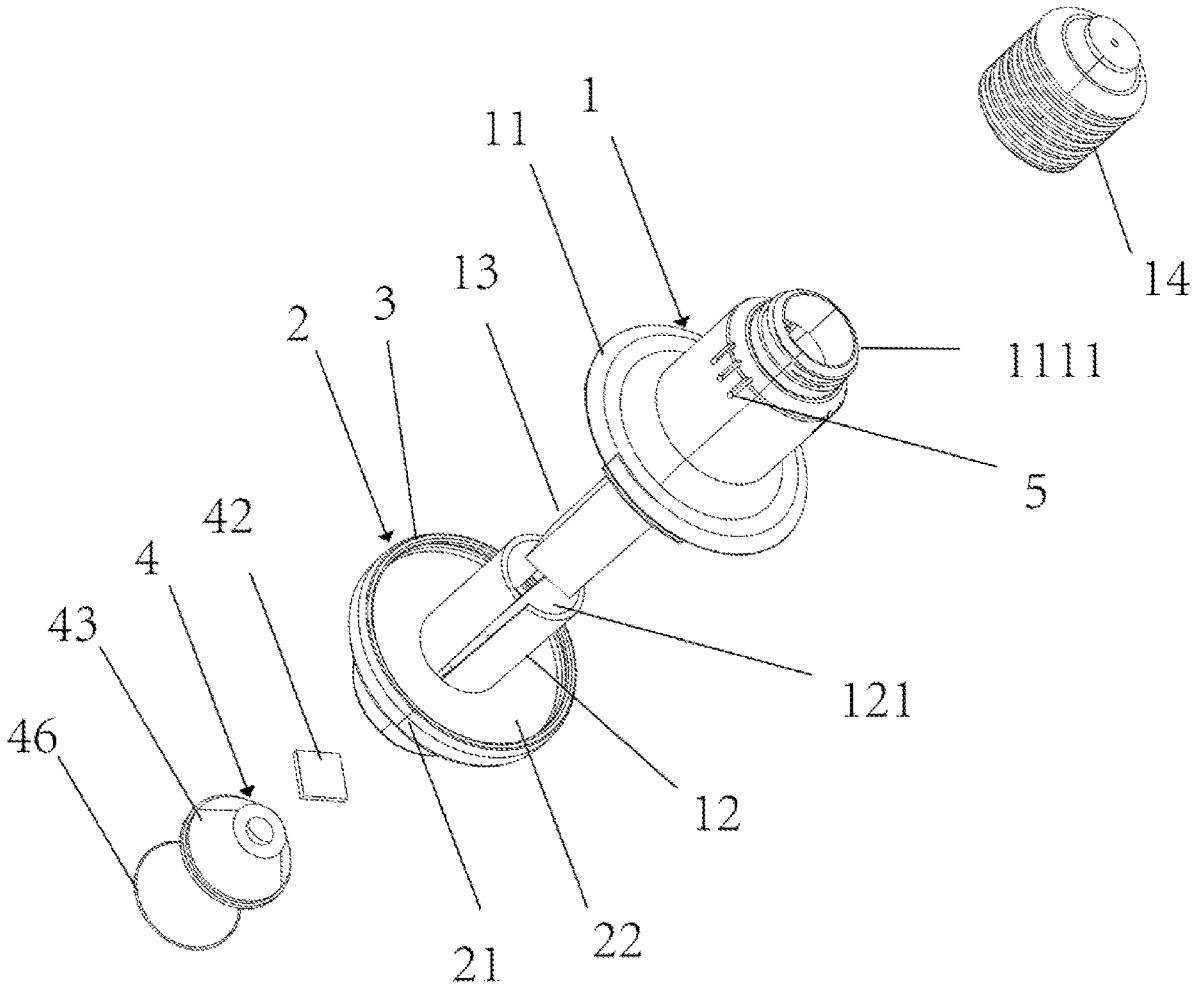
FIG. 1 is a first exploded structural schematic diagram of a lamp according to an embodiment of the invention.

Reference numerals in the drawings are:

1—power connection part; 11—transparent casing; 1111—first end part; 1112—second end part; 12—wire component; 121—accommodating space; 13—power supply component; 14—power connection component; 2—illumination part; 21—heat dissipation base; 22—light-emitting component; 3—mounting space; 4—spotlight part; 41—mounting base; 42—spotlight light source; 43—lens assembly; 44—fixed cylinder; 45—movable cylinder; 46—second clamping ring; 5—heat dissipation hole.

DESCRIPTION OF THE EMBODIMENTS

In order to make the technical problems to be solved, technical solutions and beneficial effects of the present invention more clearly, the present invention will be described in more detail with reference to the drawings and embodiments. It should be understood that the described specific embodiments are merely used to explain the present invention, rather than to limit the present invention.

Figure 2:
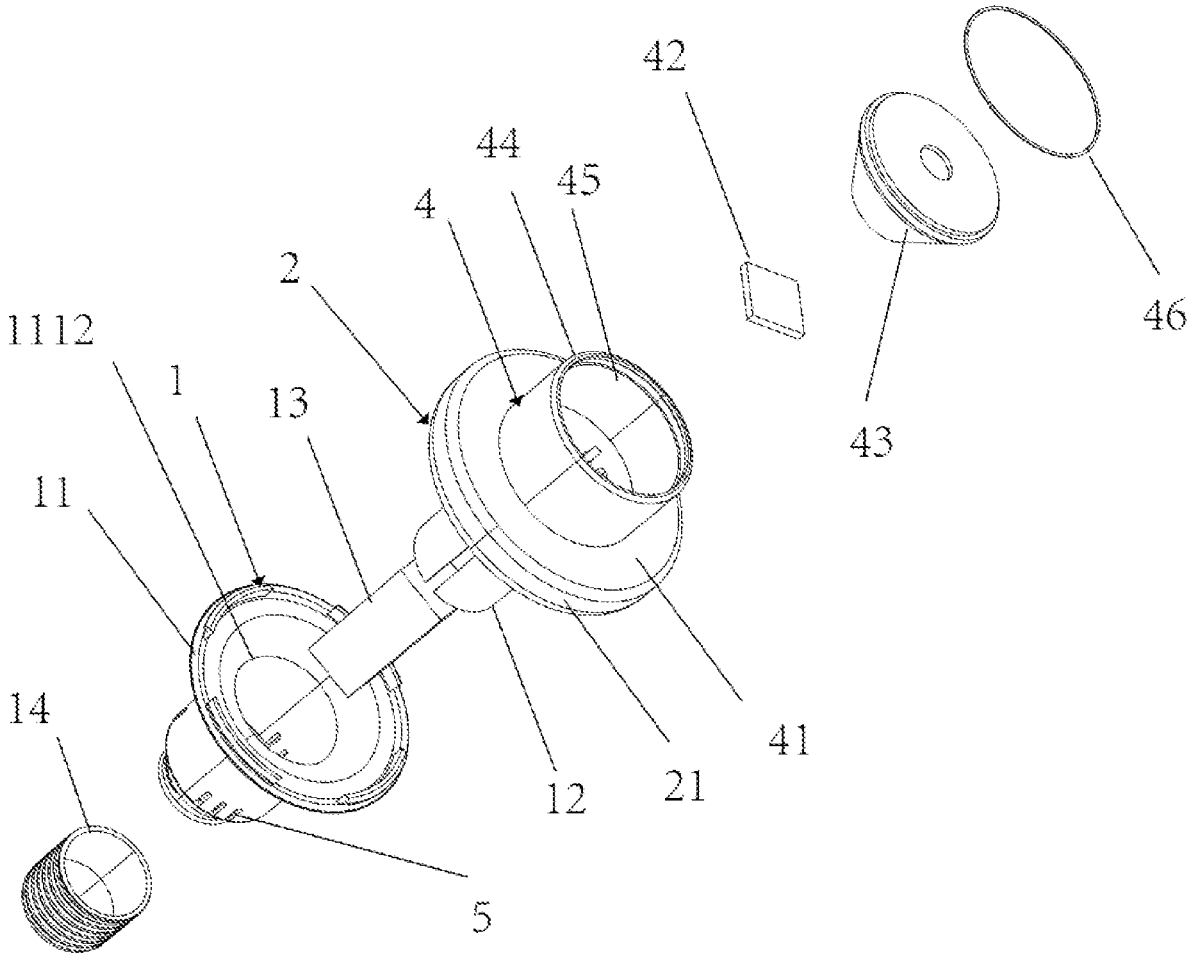
FIG. 2 is the second exploded structural schematic diagram of the lamp provided by the embodiment of the invention.

As shown in FIG. 1 and FIG. 2, a lamp provided by the embodiment of the invention includes a power connection part 1 and an illumination part 2, where the power connection part 1 includes a transparent casing 11, a wire component 12 and a power supply component 13, a mounting channel is arranged in the transparent casing 11, the mounting channel includes a first end part 1111 and a second end part 1112 communicating with the first end part 1111, the first end part 1111 and the second end part 1112 both penetrate through the transparent casing 11, the wire component 12 is inserted in the mounting channel, an accommodating space 121 is arranged in the wire component 12, the power supply component 13 is arranged in the accommodating space 121, and a port penetrating through the second end part 1112 of the transparent casing 11 is located in the accommodating space 121; the illumination part 2 includes a heat dissipation base 21 and a light-emitting component 22; the wire component 12 is fixed on the heat dissipation base 21, the heat dissipation base 21 is mounted on the transparent casing 11, and a mounting space 3 is formed between the heat dissipation base 21 and the transparent casing 11; and the light-emitting component 22 is embedded on the heat dissipation base 21, located in the mounting space 3 and outside the wire component 12, and is electrically connected with the power supply component 13, and light emitted by the light-emitting component 22 is emitted to the outside of the lamp through the transparent casing 11.

Through comparison between the lamp provided by the embodiment of the invention and the prior art, after the lamp is mounted in a preset position, and when the lamp is not used for illumination or used for illumination, the wire component 12 can be seen through the transparent casing 11, and a lamp post of a conventional lamp cannot be seen, so that the lamp has a good decorative effect. The wire component 12 plays a role in hiding the power supply component 13. The heat dissipation base 21 plays a role in heat dissipation, so that heat in the mounting space 3 can be rapidly transferred to the outside of the lamp. The light-emitting component 22 is embedded on the heat dissipation base 21, and it is difficult to see the light-emitting component 22 directly through the transparent casing 11.

Specifically, the wire component 12 is a wire cylinder.

Specifically, a user may connect a power line (not shown in the figure) with the power supply component 13, and connect the power line to an external power supply, so that the external power supply (not shown in the figure.) supplies power for the power supply component 13, and the light-emitting component 22 is controlled by the powered power supply component 13.

Specifically, the transparent casing 11 is clamped on the heat dissipation base 21, and a connection structure between the transparent casing 11 and the heat dissipation base 21 is simple and very practical.

In one embodiment, as shown in FIG. 1 and FIG. 2, heat dissipation holes 5 are formed in the transparent casing 11, and communicate with the mounting channel.

In one embodiment, the power supply component 13 includes a color-tuning power supply, the light-emitting component 22 includes a plurality of light boards, light-emitting colors of all the light boards are different, and the light boards are electrically connected to the color-tuning power supply.

The color-tuning power supply cooperates with the light boards, and the illumination part 2 has a color-changing function.

Specifically, a user may connect a power line with the color-tuning power supply, and connect the power line to the external power supply, so that the external power supply supplies power for the color-tuning power supply, the powered color-tuning power supply controls the light boards, and the lamp has a color-changing function.

Specifically, the light boards are arranged at one end of the wire component 12 in a surrounding manner.

Specifically, the light boards may realize large-angle radiation, so that the illumination part 12 has a larger radiation range.

Specifically, the color-tuning power supply is a color-tuning control circuit board or a color-tuning controller.

In one embodiment, as shown in FIG. 1 and FIG. 2, the power connection part 1 further includes a power connection component 14, the power connection component 14 is arranged on the transparent casing 11, the power supply component 13 is electrically connected with the power connection component 14, the power connection component 14 is used for being connected with the lamp holder (not shown in the figure), and the power connection component 14 covers the port penetrating through the first end part 1111 of the transparent casing 11.

When the power connection component 14 is connected to the lamp holder, a switch-on terminal on the lamp holder is used for supplying power for the power connection component 14, so that the power connection component 14 supplies power for the power supply component 13, and the use convenience of the lamp is improved. The power connection component 14 is in matched connection with the lamp holder (not shown in the figure.).

Specifically, the power connection component 14 is in threaded connection with the transparent casing 11. Preferably, the power connection component 14 is an E26 or E27 soldering lamp cap.

Specifically, the preset position is a lamp holder mounted on a wall or a lamp holder hung to a wall.

In one embodiment, as shown in FIG. 1 and FIG. 2, the lamp further includes a spotlight part 4, and the spotlight part 4 keeps off the power connection part 1 and the illumination part 2; the power supply component 13 includes a spotlight power supply; the spotlight part 4 includes a mounting base 41, a spotlight light source 42 and a lens assembly 43; and the mounting base 41 is fixed on the heat dissipation base 21, the spotlight light source 42 and the lens assembly 43 are embedded on the mounting base 41, the spotlight light source 42 is electrically connected with the spotlight power supply, light emitted by the spotlight light source 42 passes through the lens assembly 43, and the emitted light passing through the lens assembly 43 is emitted to the outside of the lamp.

The lens assembly 43 plays a role in protecting the spotlight light source 42. Light emitted by the spotlight light source 42 is spotlight.

Specifically, a user may connect a power line with the power supply component 13, and connect the power line to an external power supply, so that the external power supply supplies power for the spotlight power supply, and the spotlight light source is controlled by the powered spotlight power supply. Or when the power connection component 14 is connected to the lamp holder, a switch-on terminal on the lamp holder supplies power for the power connection component 14, so that the power connection component 14 supplies power for the spotlight power supply, and the spotlight light source is controlled by the powered spotlight power supply.

Specifically, the spotlight light source 42 is a COB light source. The spotlight power supply is a spotlight control circuit board or a spotlight controller.

In one embodiment, as shown in FIG. 1 and FIG. 2, a light-emitting end of the spotlight light source 42 faces away from the transparent casing 11, thereby ensuring that the radiation direction of the spotlight light source is opposite to that of the light-emitting component 22.

Specifically, when the lamp is mounted, the light-emitting end of the light-emitting component 22 faces upwards, and the light-emitting end of the spotlight light source faces downwards.

In one embodiment, as shown in FIG. 1 and FIG. 2, the mounting base 41 and the heat dissipation base 21 are integrally arranged, and the mounting base 41 has the function of heat dissipation, so that the heat generated by the spotlight light source is rapidly transferred to the outside of the lamp. Specifically, the heat dissipation base 21 and the mounting base 41 are aluminum components.

In one embodiment, the mounting groove (not shown in the figure) is formed in the mounting base 41, the spotlight part 4 further includes a first clamping ring (not shown in the figure), the first clamping ring is clamped on an inner wall of the mounting groove along a depth direction, and is arranged along a circumferential direction of the inner wall of the mounting groove along the depth direction, the first clamping ring is annularly arranged on the lens assembly 43, and the emitted light passing through the lens assembly 43 penetrates through an inner ring of the first clamping ring to be emitted to the outside of the lamp. The lens assembly 43 is mounted in the mounting groove through the first clamping ring, and the first clamping ring enables the lens assembly 43 not to be in direct contact with an inner wall of the mounting groove, so that the lens assembly 43 is protected. The first clamping ring has the buffering function, so that influence of an external force on the lens assembly 43 is reduced, and the lens assembly 43 is not liable to destroy.

In one embodiment, as shown in FIG. 1 and FIG. 2, the spotlight part 4 further includes a fixed cylinder 44 and a movable cylinder 45, the fixed cylinder 44 is fixed on the mounting base 41, a central shaft of the movable cylinder 45 and a central shaft of the fixed cylinder 44 are collinearly arranged, a spotlight light source is arranged in the fixed cylinder 44, the lens assembly 43 is arranged in the movable cylinder 45, and the movable cylinder 45 has a locked state and an unlocked state; and when the movable cylinder 45 is in the locked state, the movable cylinder 45 is limited on the fixed cylinder 44, and when the movable cylinder 45 is in the unlocked state, the movable cylinder 45 drives the lens assembly 43 to move away from or close to the mounting base 41 on the fixed cylinder 44.

When the movable cylinder 45 is in the unlocked state, the movable cylinder 45 drives the lens assembly 43 to change a distance between the lens assembly 43 and the spotlight light source 42, so as to change a focal length of the emitted light passing through the lens assembly 43.

In one embodiment, as shown in FIG. 1 and FIG. 2, the spotlight part 4 further includes a second clamping ring 46, the second clamping ring 46 is clamped on an inner wall of the movable cylinder 45 and is arranged along a circumferential direction of the inner wall of the movable cylinder 45, the second clamping ring 46 is annularly arranged on the lens assembly 43, and the emitted light passing through the lens assembly 43 penetrates through an inner ring of the second clamping ring 46 to be emitted to the outside of the lamp.

The lens assembly 43 is mounted in the movable cylinder 45 through the second clamping ring 46, and the second clamping ring 46 enables the lens assembly 43 not to be in direct contact with an inner wall of the movable cylinder 45, so that the lens assembly 43 is protected. The second clamping ring 46 has the buffering function, so that influence of an external force on the lens assembly 43 is reduced, and the lens assembly 43 is not liable to destroy.

Specifically, the movable cylinder 45 is in threaded connection with the fixed cylinder 44. Preferably, the movable cylinder 45 and the fixed cylinder 44 are both cylinders.

In one embodiment, the transparent casing 11 is a vaporous PC or a transparent PC, and the vaporous PC and the transparent PC have a good light-transmitting effect.

The above-mentioned contents are merely preferred embodiments of the present invention, and are not used to limit the present invention, and wherever within the spirit and principle of the present invention, any modifications, equivalent replacements, improvements, and the like shall be all included within the protection scope of the present invention.

The invention claimed is:

1. A lamp, comprising a power connection part and an illumination part, wherein the power connection part comprises a transparent casing, a wire component and a power supply component, a mounting channel is arranged in the transparent casing, the mounting channel comprises a first end part and a second end part communicating with the first end part, the first end part and the second end part both penetrate through the transparent casing, the wire component is inserted in the mounting channel, an accommodating space is arranged in the wire component, the power supply component is arranged in the accommodating space, and a port penetrating through the second end part of the transparent casing is located in the accommodating space;

the illumination part comprises a heat dissipation base and a light-emitting component;

the wire component is fixed on the heat dissipation base, the heat dissipation base is mounted on the transparent casing, and a mounting space is formed between the heat dissipation base and the transparent casing; and the light-emitting component is embedded on the heat dissipation base, located in the mounting space and outside the wire component, and is electrically connected with the power supply component, and light emitted by the light-emitting component is emitted to the outside of the lamp through the transparent casing, wherein the power supply component comprises a color-tuning power supply, the light-emitting component comprises a plurality of light boards, and light-emitting colors of all the light boards are different, and the light boards are electrically connected to a color-tuning power supply.

2. The lamp according to claim 1, wherein the power connection part further comprises a power connection component, the power connection component is arranged on the transparent casing, the power supply component is electrically connected with the power connection component, the power connection component is used for being connected with a lamp holder, and the power connection component covers the port penetrating through the first end part of the transparent casing.

3. The lamp according to claim 1, further comprising a spotlight part, wherein the spotlight part keeps off the power connection part and the illumination part;

the power supply component comprises a spotlight power supply;

the spotlight part comprises a mounting base, a spotlight light source and a lens assembly; and the mounting base is fixed on the heat dissipation base, the spotlight light source and the lens assembly are embedded on the mounting base, the spotlight light source is electrically connected with the spotlight power supply; light emitted by the spotlight light source passes through the lens assembly, and the emitted light passing through the lens assembly is emitted to the outside of the lamp.

4. The lamp according to claim 3, wherein a light-emitting end of the spotlight light source faces away from the transparent casing.

5. The lamp according to claim 4, wherein the mounting base and the heat dissipation base are integrally arranged.

6. The lamp according to claim 3, wherein a mounting groove is fainted in the mounting base, the spotlight part further comprises a first clamping ring, the first clamping ring is clamped on an inner wall of the mounting groove along a depth direction, and is arranged along a circumferential direction of the inner wall of the mounting groove along the depth direction, the first clamping ring is annularly arranged on the lens assembly, and the emitted light passing through the lens assembly penetrates through an inner ring of the first clamping ring to be emitted to the outside of the lamp.

7. The clamp according to claim 3, wherein the spotlight part further comprises a fixed cylinder and a movable cylinder, the fixed cylinder is fixed on the mounting base, a central shaft of the movable cylinder and a central shaft of the fixed cylinder are collinearly arranged, the spotlight light source is arranged in the fixed cylinder, the lens assembly is arranged in the movable cylinder, and the movable cylinder has a locked state and an unlocked state; and when the movable cylinder is in the locked state, the movable cylinder is limited on the fixed cylinder, and when the movable cylinder is in the unlocked state, the movable cylinder drives the lens assembly to move away from or close to the mounting base on the fixed cylinder.

8. The lamp according to claim 7, wherein the spotlight part further comprises a second clamping ring, the second clamping ring is clamped on an inner wall of the movable cylinder and is arranged along a circumferential direction of the inner wall of the movable part, the second clamping ring is annularly arranged on the lens assembly, and the emitted light passing through the lens assembly penetrates through an inner ring of the second clamping ring to be emitted to the outside of the lamp.

9. The lamp according to claim 1, wherein the transparent casing is a vaporous PC or a transparent PC.

* * * * *